US011602184B2

(12) United States Patent
Bitton

(10) Patent No.: US 11,602,184 B2
(45) Date of Patent: Mar. 14, 2023

(54) PROTECTIVE HAND COVERING FOR INFANTS

(71) Applicant: Cara L. Bitton, Ogden, UT (US)

(72) Inventor: Cara L. Bitton, Ogden, UT (US)

( * ) Notice: Subject to any disclaimer, the term of this patent is extended or adjusted under 35 U.S.C. 154(b) by 96 days.

(21) Appl. No.: 16/384,502

(22) Filed: Apr. 15, 2019

(65) Prior Publication Data

US 2019/0335827 A1 Nov. 7, 2019

Related U.S. Application Data

(60) Provisional application No. 62/666,551, filed on May 3, 2018.

(51) Int. Cl.

| | |
|---|---|
| ***A41D 19/01*** | (2006.01) |
| ***A41D 19/015*** | (2006.01) |
| ***A41D 19/00*** | (2006.01) |

(52) U.S. Cl.

CPC ... *A41D 19/01558* (2013.01); *A41D 19/0006* (2013.01); *A41D 19/0068* (2013.01); *A41D 19/01* (2013.01); *A41D 2300/332* (2013.01); *A41D 2400/80* (2013.01); *A41D 2500/10* (2013.01); *A41D 2500/20* (2013.01); *A41D 2500/30* (2013.01); *A41D 2500/50* (2013.01)

(58) Field of Classification Search

CPC ..... A41D 19/01558; A41D 19/0006; A41D 19/0068; A41D 19/01; A41D 2300/32; A41D 2400/80; A41D 2400/82; A41D 19/0041; A41D 19/0048; A41D 19/0034; A41D 19/0044

See application file for complete search history.

(56) References Cited

U.S. PATENT DOCUMENTS

| | | | |
|---|---|---|---|
| 1,260,865 | A | 3/1918 | Bowen |
| 2,586,608 | A | 2/1952 | Bryson |

(Continued)

FOREIGN PATENT DOCUMENTS

| | | | |
|---|---|---|---|
| KR | 200193776 | Y1 * | 8/2000 |
| KR | 20060080363 | A * | 7/2006 |

(Continued)

OTHER PUBLICATIONS

Luvable Friends Unisex Baby Cotton Scratch Mittens; Amazon.co.uk website; https://www.amazon.co.uk/4-Pack-Scratch-Mittens-Pink-Floral/dp/B071HL34QS/ref=sr_1_17?dchild=1&keywords=scratch+mittens+luvable&qid=1603885218&sr=8-17; accessed on Oct. 27, 2020; published Jan. 5, 2018. (Year: 2018).*

(Continued)

*Primary Examiner* — Daniel J Colilla

(74) *Attorney, Agent, or Firm* — Jason P. Webb; Pearson Butler

(57) ABSTRACT

A protective hand covering has a flexible shell with an open end and a closed end, and a constricted region between the open and closed ends. The constricted region defines a passage for receiving the child's hand. The hand covering may be worn by an infant or small child during sleeping or other activities, A gripping material is disposed on an inside surface of the shell at the constricted region and around the passage. The gripping material has a coefficient of friction higher than a coefficient of friction of the material of the flexible shell, such that the hand covering is discouraged from coming off of the child's hand.

18 Claims, 7 Drawing Sheets

(56) References Cited

U.S. PATENT DOCUMENTS

| | | | | |
|---|---|---|---|---|
| 3,135,966 | A | 6/1964 | Higgins | |
| 3,930,090 | A | 12/1975 | Campbell | |
| 4,328,904 | A | 5/1982 | Inverson | |
| 5,452,478 | A * | 9/1995 | Rombach | A41D 19/0048 2/159 |
| 5,809,569 | A | 9/1998 | Bruno | |
| 5,948,707 | A * | 9/1999 | Crawley | D06N 7/0092 442/101 |
| 6,155,084 | A * | 12/2000 | Andrews | A41D 13/08 66/174 |
| 8,302,798 | B2 | 11/2012 | Moss | |
| 9,498,003 | B2 * | 11/2016 | Cherneski | A41B 17/00 |
| 2005/0144703 | A1 | 7/2005 | Hilbert | |
| 2005/0222621 | A1 | 10/2005 | Duwelius | |
| 2006/0218697 | A1 * | 10/2006 | Modha | A41D 19/0089 2/161.7 |
| 2007/0288056 | A1 | 12/2007 | Goldwire | |
| 2009/0100566 | A1 | 4/2009 | Schiavino | |
| 2009/0293172 | A1 | 12/2009 | Carota | |
| 2010/0081984 | A1 * | 4/2010 | Coffinardi | D06M 23/16 602/63 |
| 2010/0186139 | A1 | 7/2010 | Kurtz | |
| 2011/0185467 | A1 * | 8/2011 | Suarez | A41D 13/05 2/22 |
| 2012/0030853 | A1 * | 2/2012 | Mountfort | A41D 19/01 2/158 |
| 2013/0227765 | A1 | 9/2013 | Bailey | |
| 2014/0115749 | A1 | 5/2014 | Weinman | |
| 2015/0209240 | A1 | 7/2015 | Steward | |
| 2016/0255892 | A1 * | 9/2016 | Berry | A41F 1/06 |
| 2016/0309816 | A1 * | 10/2016 | Roberts | A41D 15/002 |
| 2017/0099890 | A1 * | 4/2017 | Koga | A41D 19/0065 |
| 2017/0354191 | A1 * | 12/2017 | Maring | A41D 20/00 |

FOREIGN PATENT DOCUMENTS

| | | | |
|---|---|---|---|
| KR | 20120006918 U | * | 10/2012 |
| WO | WO-2017146490 A2 | * | 8/2017 |

OTHER PUBLICATIONS https://www.malarkeykids.com/products/munch-mitt-qreen-polka-dots, downloaded May 8, 2019, (webpage).

* cited by examiner

PROTECTIVE HAND COVERING FOR INFANTS

This application claims the benefit of U.S. Provisional Patent Application No. 62/666,551 filed May 3, 2018 and titled "Protective Hand Covering for Infants", the entire disclosure of which is hereby incorporated by reference herein for all purposes.

BACKGROUND OF THE INVENTION

Infant children can sometimes scratch and injure themselves inadvertently. For example an infant may scratch his or her face with a fingernail while sleeping, causing discomfort and unsightly marks.

Various measures have been proposed for preventing such scratches, for example mittens or other devices that cover the child's hands. For maximum effectiveness, such a device should stay in place on the child's hands, without falling off during sleep or other normal activity.

BRIEF SUMMARY OF THE INVENTION

According to one aspect, a protective hand covering comprises a flexible shell having a closed first end, an open second end opposite the first end, and an elastically constricted region between the first and second ends. The constricted region defines a passage between the first and second ends. The hand covering further includes a gripping material disposed on an inside surface of the shell at the constricted region and around the passage. The gripping material has a coefficient of friction higher than a coefficient of friction of the material of the flexible shell. In some embodiments, the gripping material comprises rubber. In some embodiments, the gripping material comprises silicone rubber. In some embodiments, the gripping material is arranged in a continuous band around the passage. In some embodiments, the gripping material is arranged in a plurality of separated patches disposed around the passage. In some embodiments, the gripping material has a texture on its exposed surface. In some embodiments, the texture comprises tapered ridges. The flexible shell may comprise a fabric. In some embodiments, the flexible shell comprises two layers of fabric. The gripping material may be partially infused into the fabric. In some embodiments, the flexible shell comprises a stretchable fabric. In some embodiments, the protective hand covering further comprises an elastic band disposed around and constricting the constricted region. In some embodiments, the shell has an expanded circumference of between 4.5 and 6 inches, the constricted region has a constricted inner circumference of less than 3 inches, and the constricted region is positioned between 1.0 and 2.0 inches from the open end of the shell. In some embodiments, the portion of the shell between the closed end and the constricted region is of a shape and size to contain a hand of an infant less than one year old, and the constricted region is of a size to enclose the wrist of an infant less than one year old.

According to another aspect, a mitten comprises a flexible shell including a body portion having a closed end for receiving a hand, and a cuff portion having an open end sized for fitting over a wrist of an infant of young child. The mitten further comprises a gripping material disposed on an inside surface of the shell at a transition zone between the body portion and the cuff portion. The gripping material has a coefficient of friction higher than a coefficient of friction of the material of the flexible shell. The transition region is of a size smaller than the hand of the infant or young child. In some embodiments, the mitten further comprises elastic disposed around the shell at the transition zone, the elastic material urging the shell toward closure at the transition zone. In some embodiments, the elastic has an unstretched length of between 2.5 and 3.5 inches. In some embodiments, the mitten is thumbless. In some embodiments, an exposed surface of the gripping material is textured, the texture comprising tapered ridges. In some embodiments, an exposed surface of the gripping material is textured with ridges disposed at an angle to a longitudinal axis of the mitten.

DETAILED DESCRIPTION OF THE INVENTION

Figure 1:
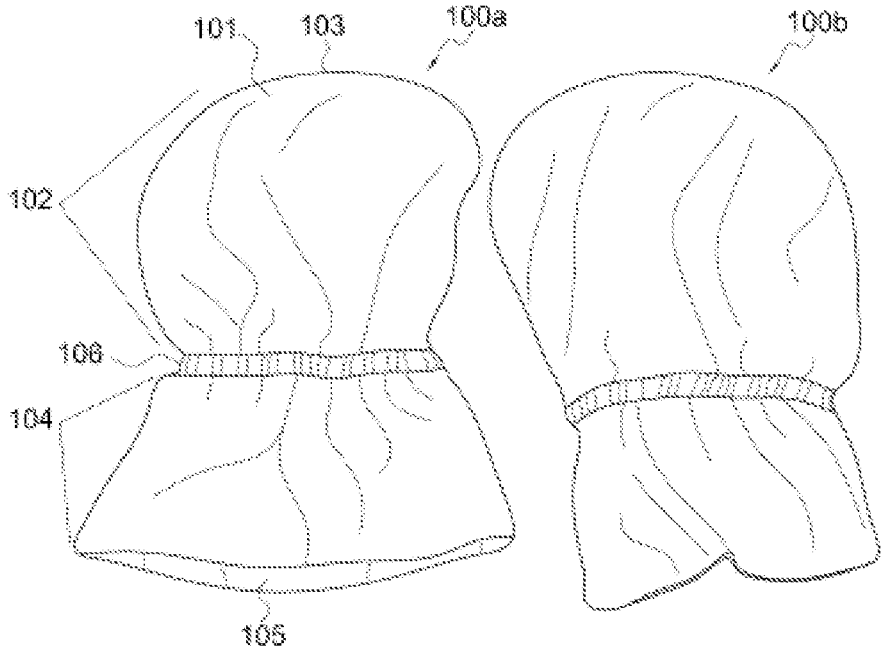
FIG. 1 depicts a pair of protective hand coverings in accordance with embodiments of the invention.

FIG. 1 depicts a pair of protective hand coverings 100*a* and 100*b* in accordance with embodiments of the invention. Each of hand coverings 100*a* and 100*b* is in the form of a mitten having a flexible shell 101. The flexible shell 101 has a body portion 102 with a closed end 103. The body portion 102 is preferably of a shape and size to loosely fit over the hand of an infant or young child. The shell 101 also has a cuff portion 104, which has an open end 105.

An elastically constricted region 106 is positioned at a transition between the body portion 102 and the cuff portion 104. The elastically constricted region 106 is preferably of a shape and size to enclose and gently touch or nearly touch the wrist of an infant or young child. For example, the constricted region 106 may be smaller than the hand of the infant or young child, so that the hand covering 100*a* is constrained to stay on the hand.

Figure 2:
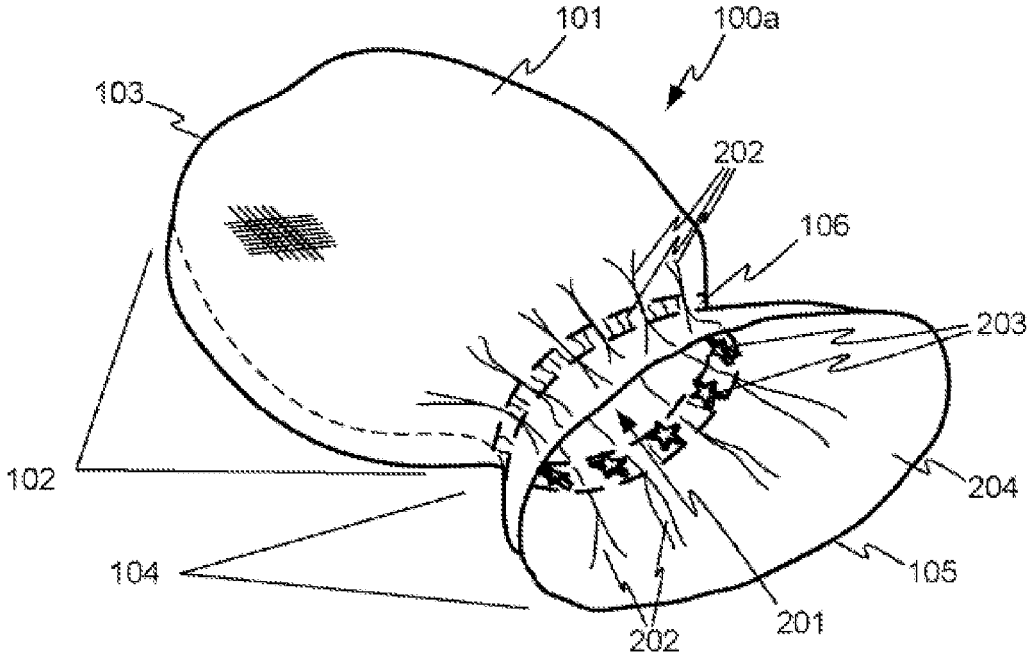
FIG. 2 is a perspective view of one of the hand coverings of FIG. 1, partially opened to show additional details of its construction.

FIG. 2 is a perspective view of hand covering 100*a*, partially opened to show additional details of its construction. (Embodiments of the invention will be described with regard to the hand covering 100*a*, but it will be recognized that the description applies to the second hand covering 100*b* as well. However, it is not a requirement that the two hand coverings be identical.) Elastically constricted region 106 defines a passage 201 between the open end 105 and the closed end 103, through which a child's hand can be inserted.

In the embodiment of FIG. 2, the constricted region 106 is formed by a band of elastic (not visible in FIG. 2) sewn into the shell 101. The elastic band urges the constricted region 106 toward closure of the passage 201. The constriction may cause pleats or gathers 202 to form in the shell 101.

A gripping material 203 is disposed on an inside surface 204 of the shell 101, at the constricted region 106 and around the passage 201. The gripping material 203 may be any suitable material that has a higher coefficient of friction than the surrounding fabric, and thus helps to prevent the hand covering 100*a* from inadvertently slipping off of an infant's hand. For example, the gripping material 203 may be a rubber such as silicone rubber, or another suitable material. In the embodiment of FIG. 2, the gripping material 203 is disposed in a plurality of separate star-shaped patches around the passage 201. Any workable patch shape may be used, for example a paw print shape, a flower shape, a geometric shape, or another shape. The shapes of the patches may be selected in keeping with the style of the particular hand covering. For example, if the shell 101 is made of a fabric with an animal print, then the patches may be shaped as paw prints, or if the shell 101 is made of a fabric with a floral print, then the patches may be shaped like leaves.

In other embodiments the gripping material may be disposed continuously around the passage 201, rather than being in discrete patches. However, discrete patches may be preferred, as they may be less prone to dislodging from the material of the shell 101 due to the gathering of the constricted region 106.

The gripping material 203 may be applied in any suitable way. For example, in a preferred embodiment, the shell 101 may be made of a fabric, and the gripping material 203 may be partially infused into the fabric for a secure attachment. Other attachment methods may be used as well. For example, the gripping material 203 may be applied to the inside surface 204 of the shell by adhesion of the gripping material 203 itself or by an additional applied adhesive.

Figure 3:
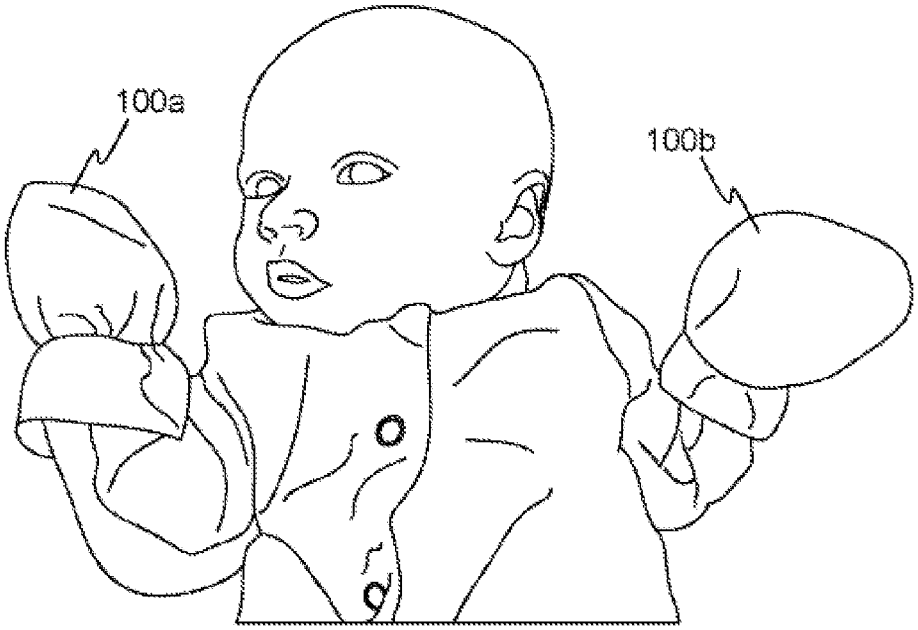
FIG. 3 shows two hand coverings, in accordance with embodiments of the invention, being worn by an infant.

FIG. 3 shows two hand coverings 100*a* and 100*b*, in accordance with embodiments of the invention, being worn by an infant.

The hand coverings 100*a* and 100*b* may be made of any suitable materials and by any suitable methods. For example, the shell 101 may be made of a woven, knitted, or nonwoven fabric. The fabric may be made of a natural material such as cotton or wool, or of a synthetic material such as polyester, or of a blend of materials. In some embodiments, the shell 101 may comprise flannel. The shell 101 may be made of a single layer of fabric, or multiple layers. For example, a two-layer shell may have a durable synthetic or blend outer layer, with a soft natural fabric liner. The layers may be quilted together if desired. In some embodiments, one portion of the shell 101 may have a single layer, but another portion may have two layers. For example, body portion 102 may be of a single layer, but cuff portion 104 may have two layers.

In other embodiments, the shell 101 may be formed a molded polymer or other material. Any workable combination of materials may be used. For example, body portion 102 may be made of a different material than cuff portion 104.

In some embodiments, the shell 101 may be made of a naturally stretchy material, for example a knitted fabric similar to the material commonly used to make socks. The material may include a blend of fibers including elastane or another material that enhances the stretchiness of the material. One commercial version of elastane is known under the trade name Spandex™.

When the shell material is naturally stretchy, it may not be necessary to include any elastic band in the hand covering 100*a*. In that case, the constricted region 106 may be formed by the shell 101 conforming to the wrist of a child wearing the hand covering 100*a*.

In some embodiments, the hand covering 100*a* may be reversible. In this case, gripping material 203 may be placed around both the inside and outside of the constricted region 106, so that gripping material is disposed toward the wrist of the child regardless of whether the hand covering 100*a* has been reversed. In other embodiments, gripping material may be disposed around the outside of the constricted region 106 for decorative purposes.

Figure 4:
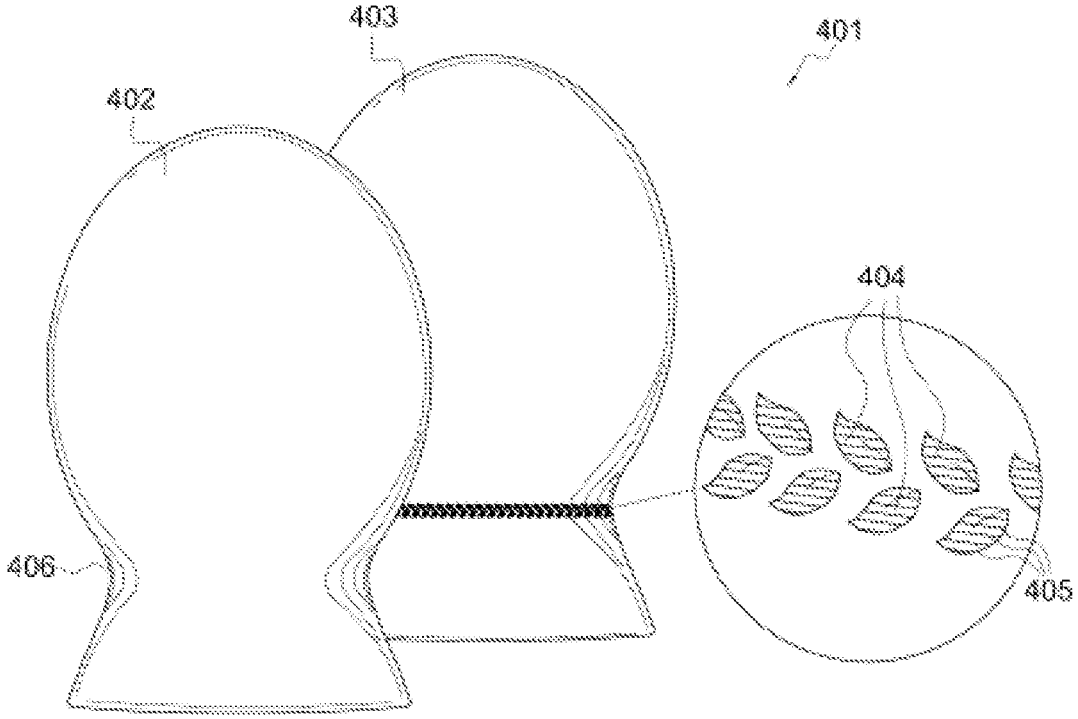
FIG. 4 illustrates a hand covering in accordance with other embodiments of the invention.

FIG. 4 illustrates a hand covering 401 in accordance with other embodiments. The hand covering 401 is shown in its normal configuration for use 402, and also "inside out" at 403. The inside out configuration exposes the gripping material 203, which in this case is disposed in discrete patches 404 in the shape of leaves, in keeping with the foliage print on the outside of the hand covering 401. The gripping material 203 may be textured on its exposed surface. As shown in the inset portion of FIG. 4, the discrete patches 404 are textured with tapered (sharp-peaked) ridges 405 on their surfaces, but any suitable texturing shape may be used, for example ridges, grooves, ripples, stipples, pillars, or other suitable shapes. Combinations of shapes may be used in the texturing. The texturing may be arranged to enhance the friction between the gripping material 203 and the skin of a child, to further assist in keeping the hand covering 401 on the child's hand.

The hand covering 401 is also an example of a hand covering without an internal elastic band. For example, the hand covering 401 may be made of a naturally stretchy material. A constricted region 406 may be formed during fabrication of the hand covering 401, or by the material conforming to the wrist of a child wearing the hand covering 401.

Figure 5:
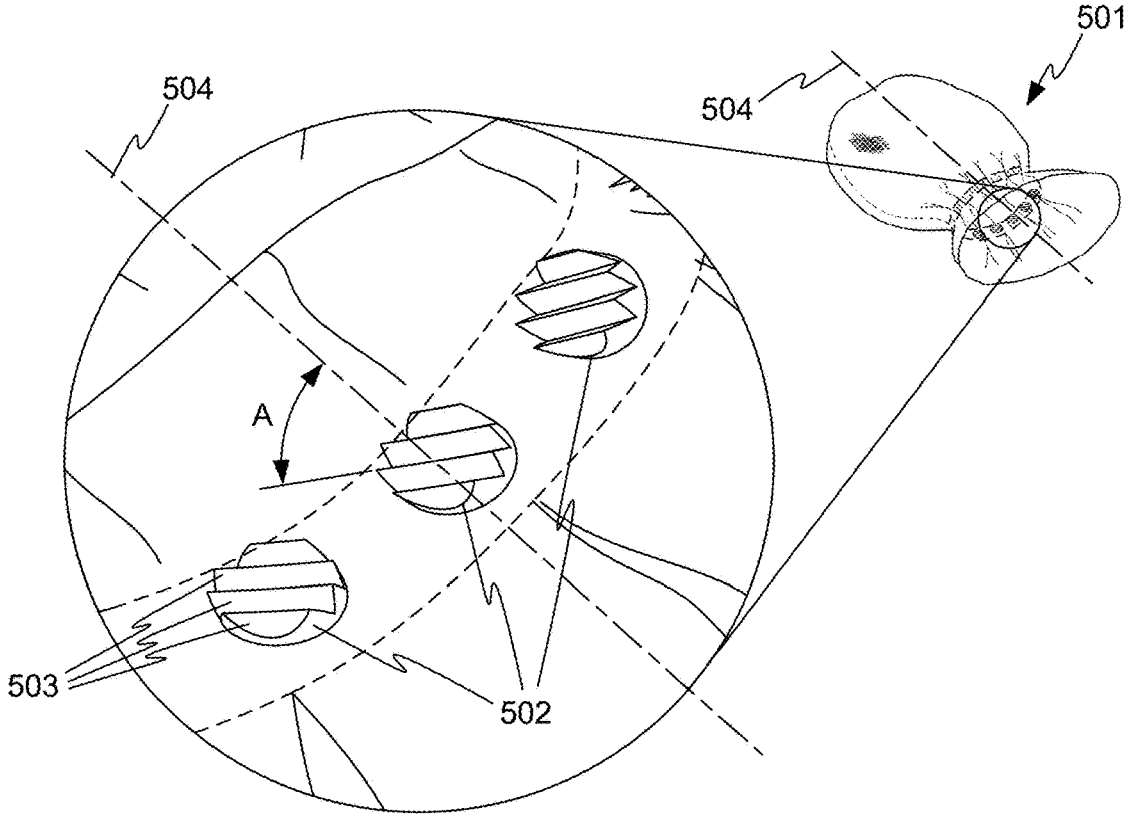
FIG. 5 illustrates a hand covering in accordance with other embodiments of the invention.

In some embodiments, the texturing of the gripping material 203 may be angled with respect to an axis of the hand covering. FIG. 5 illustrates a hand covering 501 in accordance with such an embodiment. In this example, the gripping material 203 is placed in a number of discrete patches 502 around the constricted region of the hand covering 501. Each of the patches 502 is textured with tapered ridges 503. The tapered ridges 503 are oriented at an angle A to a longitudinal axis 504 of the hand covering 501. In this example, angle A is approximately 45 degrees, but other angles may be used. While the ridges 503 shown in FIG. 5 are simple straight ridges, other texture patterns may be used, for example a zig-zag, herringbone, helical, wavy, or other pattern.

FIGS. 6-13 illustrate one example method of making a hand covering such as the hand covering 100*a*.

Figure 6:
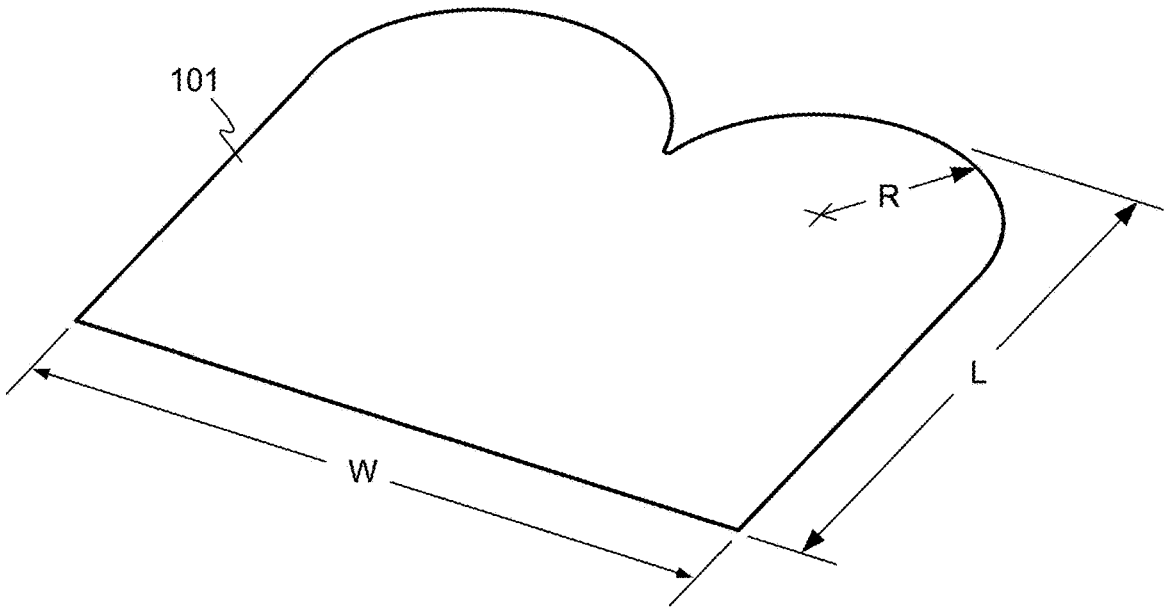
FIG. 6 illustrates a step in one example method of making a hand covering as shown in FIGS. 1 and 3.

As shown in FIG. 6, the shell 101 may be cut from a flat piece of fabric, according to a suitable pattern or template. While other sizes are possible, the width "W" may be about 7.2 inches, the length "L" may be about 6.5 inches, and the radius "R" may be about one-fourth of the width W.

Figure 7:
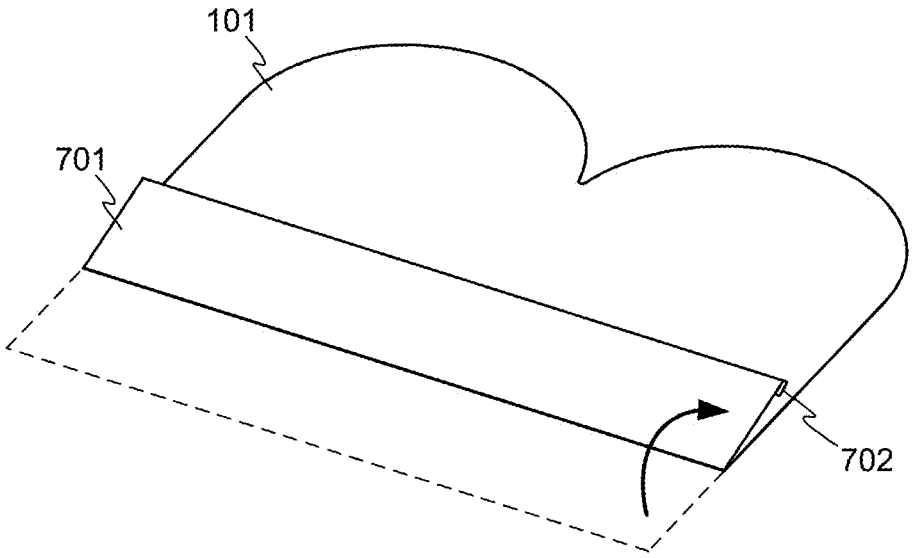
FIG. 7 illustrates another step in the example method of making the hand covering.

As shown in FIG. 7, a bottom portion 701 of the shell 101 is folded back on the shell 101. This fold will form the cuff portion 104 of the hand covering 100*a*. If desired, the free edge 702 may be folded under to form a finished seam, as shown. In other embodiments, the free edge 702 may simply be sewn flat against the shell 101 and left unfinished.

Figure 8:
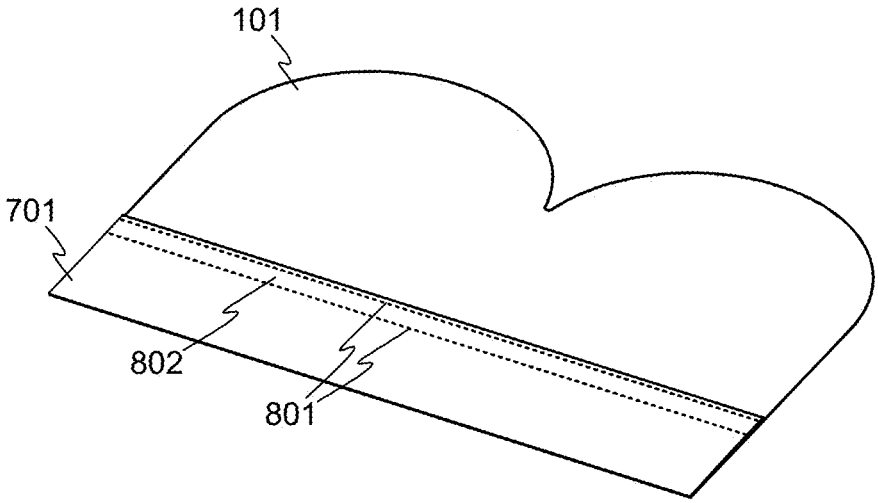
FIG. 8 illustrates another step in the example method of making the hand covering.

As shown in FIG. 8, the bottom portion 701 is sewn to the rest of the shell 101, using two spaced-apart rows of stitches 801. In this example, stitching rows 801 are parallel straight lines, but other shapes could be used. For example, spaced-apart wavy stitching could be used for an additional decorative effect. The rows of stitching 801 form a pocket 802, bounded by the shell material and limited by the stitching rows.

Figure 9:
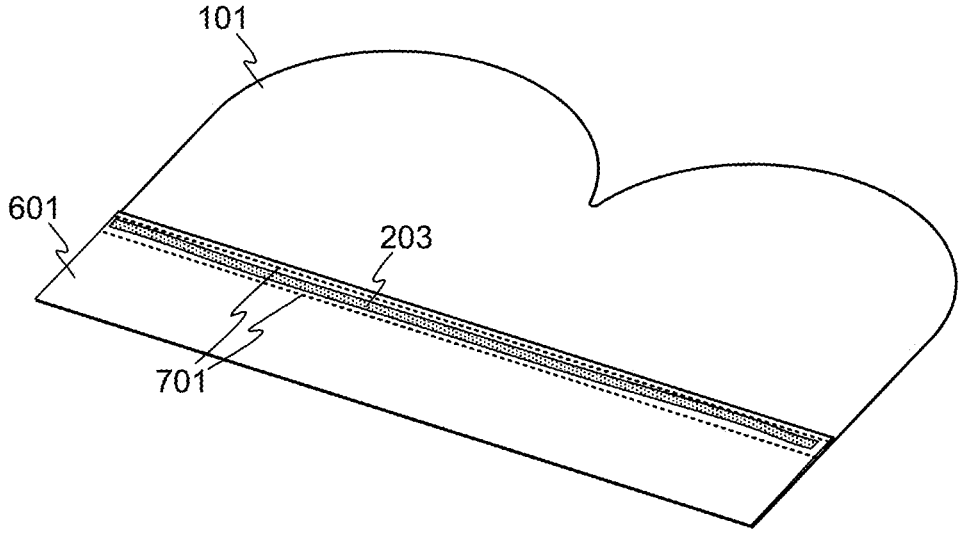
FIG. 9 illustrates a gripping material applied to the hand covering, in accordance with embodiments of the invention.
Figure 10:
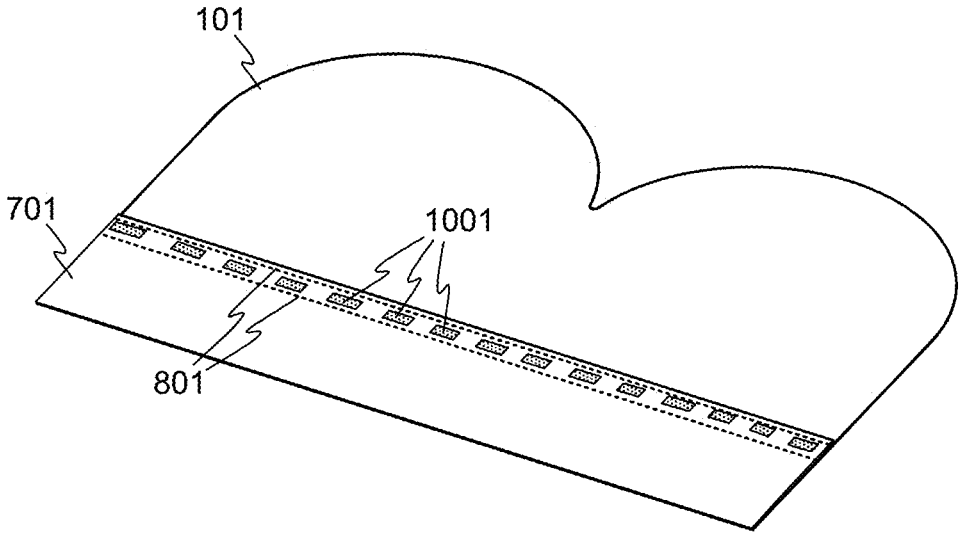
FIG. 10 illustrates a gripping material applied to the hand covering, in accordance with other embodiments of the invention.

The gripping material 203 may then be applied, as shown in FIG. 9. For example, gripping material 203 may be a bead of silicone rubber applied to the surface of the shell 101 between the stitching rows 801. In other embodiments, for example as shown in FIG. 10, the gripping material 203 may be applied in separated patches 1001. The gripping material 203 may then be allowed to cure, for example overnight.

In other embodiments, the gripping material 203 may have been previously applied to the material of the shell 101, so that a curing step is not necessary during construction of the hand covering. For example, the gripping material 203 may have been at least partially infused into the material of the shell 101 in a suitable configuration, and the shell 101 may be cut so that the pre-existing gripping material 203 falls at the elastically constricted region 106 of the hand covering 100*a*.

Figure 11:
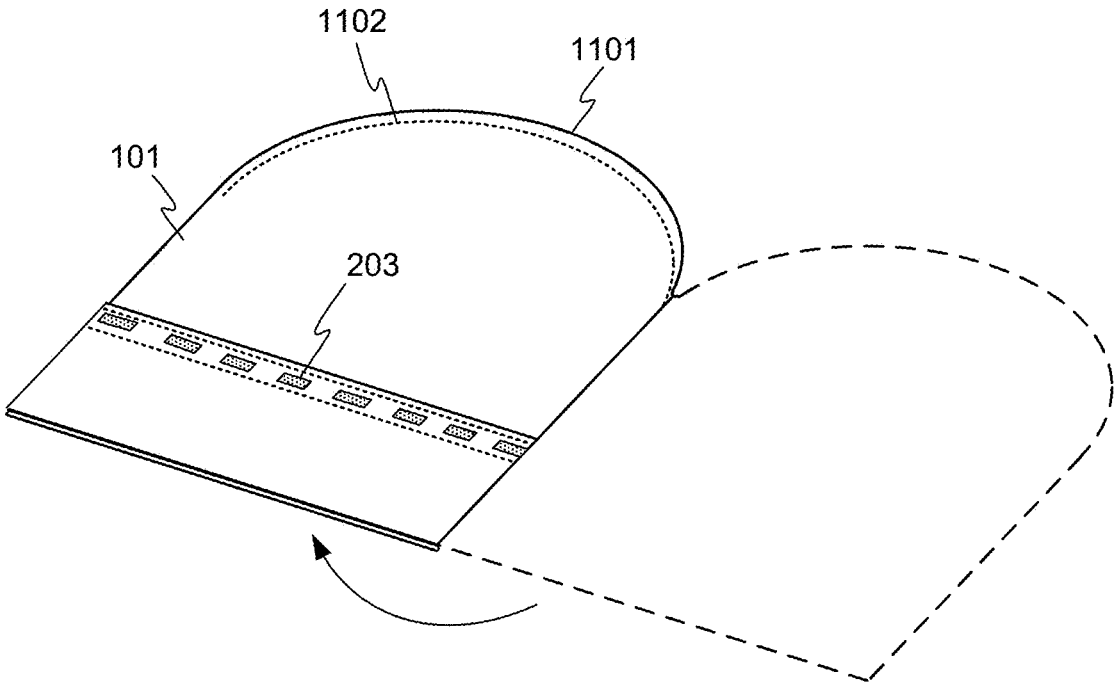
FIG. 11 illustrates another step in the example method of making the hand covering.

As shown in FIG. 11, one half of the shell 101 is folded under the other half, so that the gripping material 203 is exposed. It will be appreciated that at this stage, the covering is "inside out" as compared with its eventual configuration for use. The ends 1101 of the shell 101 are aligned, and a row of stitching 1102 is put in place to attach the two halves of the shell 101 together at the ends 1101.

Figure 12:
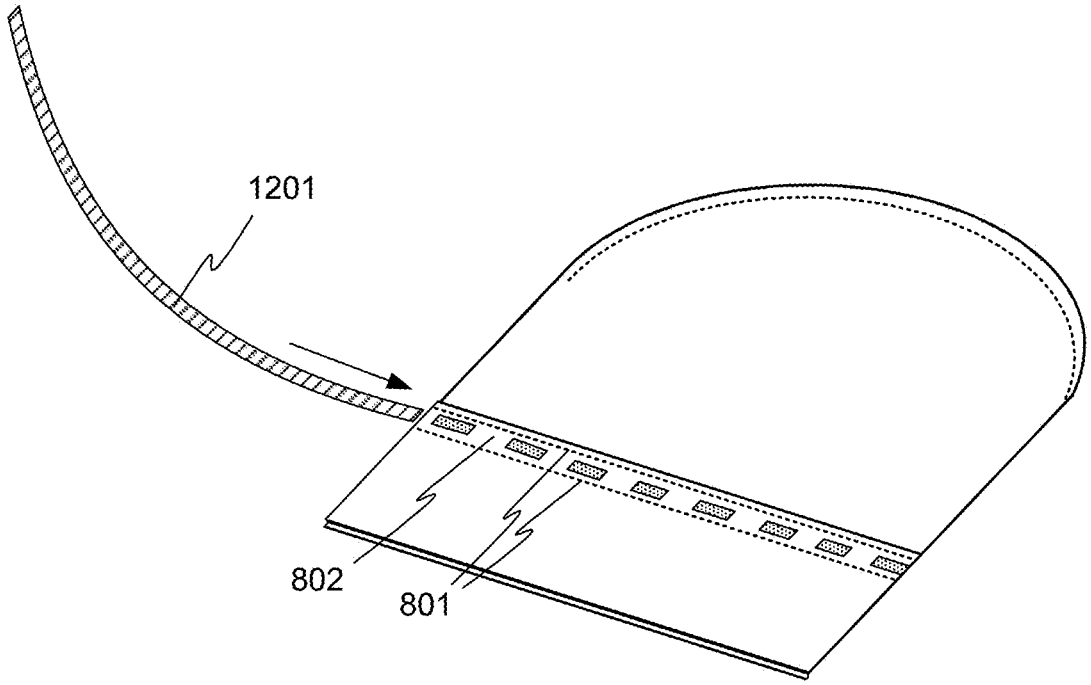
FIG. 12 illustrates another step in the example method of making the hand covering.

As shown in FIG. 12, an elastic band 1201 is threaded into the pocket 802 between the stitching rows 801. The threading may be facilitated by attaching the leading end of the elastic 1201 to a safety pin or bodkin, which is removed later.

The elastic 1201 will form the elastically constricted region 106 of the hand covering 100*a*, and is preferably selected to have a length and stiffness that will result in a lightly snug and comfortable fit of the gripping material 203 of the hand covering 100*a* over the wrist of an infant or small child, while substantially preventing the hand covering 100*a* from inadvertently slipping off of the child's hand.

In general, the length of the elastic 1201 may be somewhat less than the circumference of the wrist of the child, when the elastic is in its unstretched state. In some embodiments, the elastic may about ½ to 2 inches shorter than the circumference of the wrist of the child, depending on the width and stiffness of the elastic. The circumference of a child's wrist depends on the age of the child, but may be given approximately by the measurements in Table 1 below, derived from online sources and independent measurements.

TABLE 1

Child's wrist circumference by age.

| | Child's Age | | | | | |
|---|---|---|---|---|---|---|
| | Newborn | 3 months | 6 months | 12 months | 18 months | 2 years |
| Wrist Circumference (inches) | 3.75-4.75 | 4.25-5 | 4.25-5.25 | 4.5-5.25 | 4.5-5.25 | 4.75-5.5 |

In other embodiments, the elastic 1201 may have an unstretched length comparable to or even slightly larger than the child's wrist diameter.

In one embodiment that has been found suitable for making a hand covering for a newborn, the elastic 1201 has a width of ⅛ inch and an unstretched length of 3 inches. Other lengths may be used, depending on the desired fit and the age of the child for whom the hand covering is intended.

Figure 13:
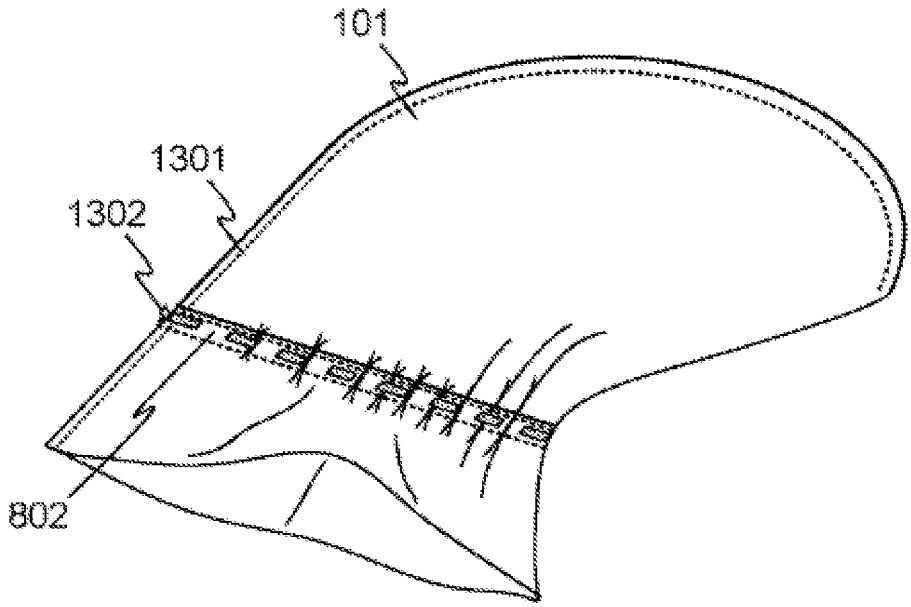
FIG. 13 illustrates another step in the example method of making the hand covering.

As shown in FIG. 13, a final stitching row 1301 may then be put in place. Stitching row 1301 completes the joining of the two sides of the shell 101, and also captures the ends 1302 of the elastic 1201, so that the elastic 1201 forms a closed loop, secured within the pocket 802. The ends 1302 of the elastic 1201 may be trimmed off if desired. In other embodiments, one end of the elastic 1201 may be tacked to the shell 101 before the other end is pulled completely through the pocket 802, to prevent the tacked end from being inadvertently pulled into the pocket 802.

Figure 14:
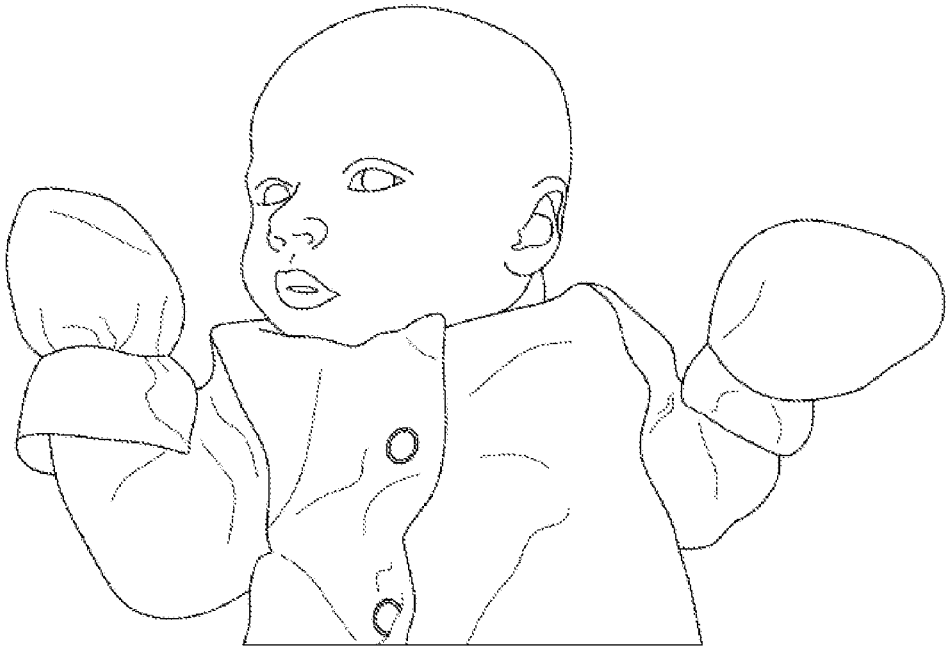
FIG. 14 is a photograph of a child wearing hand coverings in accordance with embodiments of the invention.

The completed hand covering 100*a* is then inverted from its "inside out" state, and is ready for use, as shown in FIGS. 1-3. FIG. 14 also shows a photograph of a child wearing hand coverings embodying the invention, for additional clarity. Using the template and steps described above, the shell 101 of the completed hand covering 100*a* may have an expanded circumference of between 4.5 and 6 inches, the constricted region 106 may have a constricted inner circumference of less than 3 inches, the constricted region may be positioned between 1.0 and 2.0 inches from the open end 105 of the shell 101, and the body portion 102 may have a length (from the constricted region 106 to the closed end 103) of about 3.0 to 4.0 inches. In other embodiments, the cuff portion 104 of the hand covering 100*a* may be shortened or eliminated, so that the constricted region 106 is essentially at the edge of the hand covering 104.

It will be recognized that hand coverings according to embodiments of the invention may be made in other ways. For example, the steps above could be performed in a different order. In one simple example, stitching 1102 and 1301 could be placed in one step at the end of the construction of the hand covering 100*a*.

In other embodiments, other fabrication techniques could be used. For example, the shell 101 could be knitted in one piece of a naturally-elastic material, with the gripping material 203 added to the knitted article. In other embodiments, joining techniques other than stitching may be used. For example, an adhesive may be used to join the halves of the shell together, or the halves may be heat welded if the material of the shell is suitable.

Many other variations are possible within the scope of the appended claims. For example, while the hand covering 100*a* is a thumbless mitten, a thumb could be provided. In other embodiments, the shell 101 may be decorated in any desired way. For example, a print fabric may be used with a decorative pattern depicting such items as cartoon characters, animals, geometric patterns, flowers or other plants, superheroes, spaceships, stars, planets, candies, holiday symbols, or any other item in keeping with the style of the particular hand covering.

The invention has now been described in detail for the purposes of clarity and understanding. However, those skilled in the art will appreciate that certain changes and modifications may be practiced within the scope of the appended claims.

What is claimed is:

1. A protective hand covering comprising:

a flexible shell having a closed first end, an open second end opposite the first end, and an elastically constricted region between the first and second ends, the constricted region defining a passage between the first and second ends and defining a body portion of the flexible shell configured to loosely fit over the hand of an infant or young child and a cuff portion configured to loosely extend from the constricted region around the arm of the infant or young child, wherein the flexible shell comprises two layers of fabric;

a gripping material disposed on an inside surface of the shell at the constricted region and around the passage, the gripping material having a coefficient of friction higher than a coefficient of friction of the material of the flexible shell, wherein the gripping material is arranged in a plurality of separated patches disposed about the passage and not disposed elsewhere on the flexible shell; and further comprising an elastic band disposed around and constricting the constricted region.

2. The protective hand covering of claim 1, wherein the gripping material comprises rubber.

3. The protective hand covering of claim 1, wherein the gripping material comprises silicone rubber.

4. The protective hand covering of claim 1, wherein the gripping material has a texture on its exposed surface.

5. The protective hand covering of claim 4, wherein the texture comprises tapered ridges.

6. The protective hand covering of claim 1, wherein the gripping material is partially infused into the inside surface of the flexible shell.

7. The protective hand covering of claim 1, wherein the flexible shell comprises a stretchable fabric.

8. The protective hand covering of claim 1, wherein:

the shell has m expanded circumference of between 4.5 and 6 inches;

the constricted region has a constricted inner circumference of less than 3 inches; and the constricted region is positioned between 1.0 and 2.0 inches from the open end of the shell.

9. The protective hand covering of claim 1, wherein the portion of the shell between the closed end and the constricted region is of a shape and size to contain a hand of an infant less than one year old, and the constricted region is of a size to enclose the wrist of an infant less than one year old.

10. The protective hand covering of claim 1, wherein the distance from any constricted region to the first end is larger than the distance to the second end.

11. The protective land covering of claim 1, wherein the entire section of fabric on the second end side of any constricted region is loose flowing fabric.

12. The protective hand covering of claim 1, wherein the second end section of loose fabric consists of a single piece of fabric circumferentially disposed around the elastically constricted region.

13. The protective hand covering of claim 1, wherein the first end section of loose fabric consists of a single layer of fabric circumferentially disposed around the elastically constricted region.

14. The protective hand covering of claim 1, wherein the second end is at least twenty percent wider than the constricted region.

15. A mitten, comprising:

a flexible shell including a body portion having a closed end for receiving a hand, and a cuff portion having an open end sized for fitting over a wrist of an infant of a young child; and a gripping material disposed on an inside surface of the shell at a transition zone between the body portion and the cuff portion, the gripping material having a coefficient of friction higher than a coefficient of friction of the material of the flexible shell, and the gripping material having a top surface that is shaped as an array of accordion pleats set at an angle to a longitudinal axis of the mitten, wherein the transition region is of a size smaller than the hand of the infant or young child.

16. The mitten of claim 15, further comprising:

an elastic material disposed around the shell at the transition zone, the elastic material urging the shell toward closure at the transition zone.

17. The mitten of claim 16, wherein the elastic has an unstretched length of between 2.5 and 3.5 inches.

18. The mitten of claim 15, wherein the mitten is thumbless.

* * * * *